United States Patent [19]

Calkins et al.

[11] Patent Number: 4,775,265

[45] Date of Patent: Oct. 4, 1988

[54] REMOVABLE CLOSURE DEVICE

[75] Inventors: Dennis E. Calkins, Houston; James A. Haney, Bellaire, both of Tex.

[73] Assignee: McDermott Incorporated, New Orleans, La.

[21] Appl. No.: 72,827

[22] Filed: Jul. 13, 1987

[51] Int. Cl.[4] ..... E02D 13/04

[52] U.S. Cl. ..... 405/227; 405/195; 405/224

[58] Field of Search ..... 405/227, 195, 232, 224, 405/228; 175/220, 5, 7; 292/235

[56] References Cited

U.S. PATENT DOCUMENTS

| | | | |
|---|---|---|---|
| 1,083,341 | 1/1914 | Sousae et al. | 175/220 X |
| 1,375,092 | 4/1921 | Hanson | 175/220 X |
| 2,959,016 | 11/1960 | Parks | 405/228 |
| 3,387,460 | 6/1968 | Morris | 405/228 |
| 3,420,066 | 1/1969 | Bishop | 405/227 |
| 4,110,993 | 9/1978 | Heerema | 405/228 |
| 4,190,119 | 2/1980 | Loftis et al. | 175/220 X |
| 4,311,347 | 1/1982 | Cobb | 175/220 X |

*Primary Examiner*—Dennis L. Taylor

*Attorney, Agent, or Firm*—Robert J. Edwards; Michael L. Hoelter

[57] ABSTRACT

A fixed pile guide having a removable ring gate which restrains a pile within the pile guide. When in the closed position, the ring gate is secured to the guide by means of a pivotable arm. To release the pile and/or to convert the guide to an open pile guide, a cable secured to the arm is pulled which pivots the arm thereby releasing the gate from the fixed guide as well as releasing restraint on the pile.

6 Claims, 2 Drawing Sheets

REMOVABLE CLOSURE DEVICE

FIELD OF THE INVENTION

The present invention relates to the art of pile driving and more specifically to a pile guide capable of both securing a pile to a structure and thereafter guiding the pile as it is being driven.

BACKGROUND OF THE INVENTION

Pile guides are used on such structures as offshore jackets to properly align skirt piles, follower piles, and/or the hammer during the pile driving operation. In the case of closed pile guides, such follower and skirt piles can be preloaded onto the structure before it is launched which is a significant cost savings over having to load such elongated and unwieldly piles in the ocean. However, should additional lengths of the skirt pile be necessary or should more follower pile lengths be needed, the cost savings associated with preloading is consumed by the pains-taking process of threading these additional lengths through the closed guides. Open pile guides, on the other hand, are considerably easier to reload in the field but by being open, the cost savings of preloading onto the structure is not available.

Convertible-type pile guides which are closed through jacket launching and positioning and then opened prior to pile driving permit the advantages of preloaded piles to be combined with the advantages of open pile guides. Such convertible guides often are designed as hinged clamps that are held closed by bolts, hydraulically activated rams, or both. Clamps held closed only by bolts are less expensive to fabricate than hydraulic devices but they entail the expense of offshore divers when the time comes to remove these bolts. Hydraulically activated clamps reduce or eliminate the need for divers but their fabrication cost is very high. In the past, the high cost of bolted or hydraulic type convertible pile guides often offset the cost savings of combining preloaded pilings with the open pile guide method of pile installation.

It is thus an object of this invention to provide a pile guide that combines the cost savings of preloading with the ease of re-loading. Another object of this invention is to provide an inexpensive and reliable method of converting from a closed pile guide to an open pile guide.

SUMMARY OF THE INVENTION

This invention pertains to a pile guide sized to partially fit around a pile with a ring gate surrounding the remaining portion of this pile. The pile guide includes connecting means for removably securing the ring gate to the pile guide, these means including a pivoting arm which, when pivoted, releases and removes the ring gate from the pile guide thereby transforming the previously closed pile guide into an open pile guide.

DETAILED DESCRIPTION OF THE INVENTION

Figure 1:
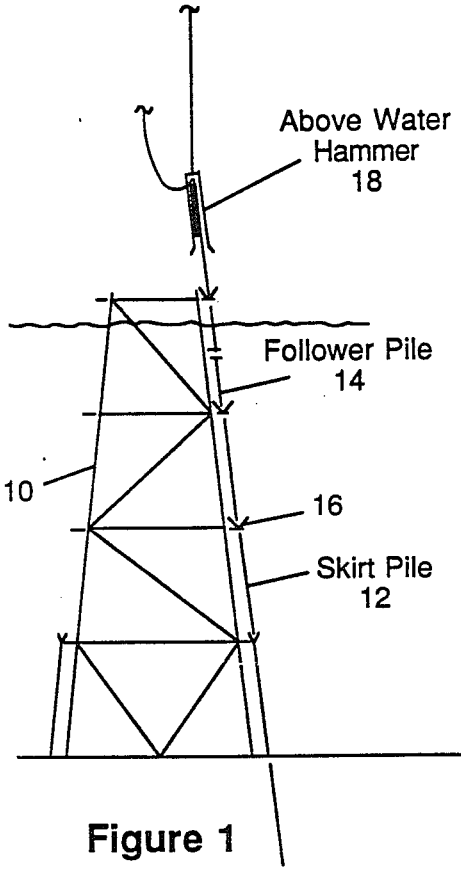
FIG. 1 is an illustration of an offshore structure showing a skirt pile, a follower pile, and an above water hammer, all of which are typically used in conjunction with a closed pile guide.

Referring initially to FIG. 1, there is shown offshore structure 10 with skirt pile 12 and follower pile 14 supported within pile guides 16. An above water hammer 18 drives these piles through guides 16, which in all likelihood, would be of the closed variety since the piles would, for cost savings, be preloaded onto structure 10 prior to its launching. Should any additional lengths of follower pile 14 be needed they would be threaded through closed guides 16 from above.

Figure 2:
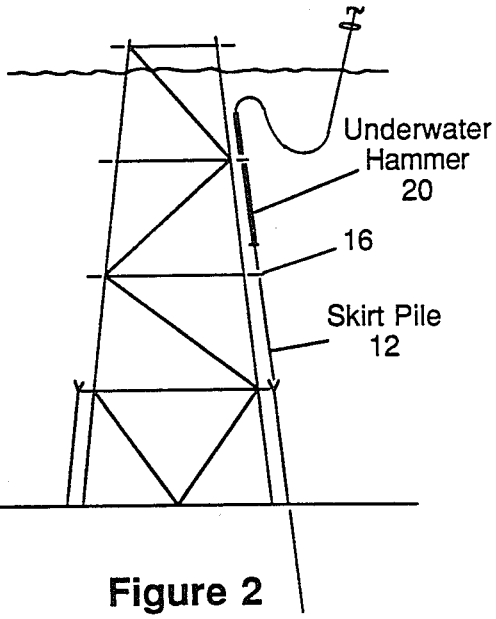
FIG. 2 is an illustration of an offshore structure showing a skirt pile and an underwater hammer which are typically used in conjunction with an open pile guide.

FIG. 2 shows underwater hammer 20 driving skirt pile 12 through guides 16. In this instance, guides 16 would be of the open variety since hammer 20 would pass through guides 16 as skirt pile 12 becomes embedded.

Figure 3:
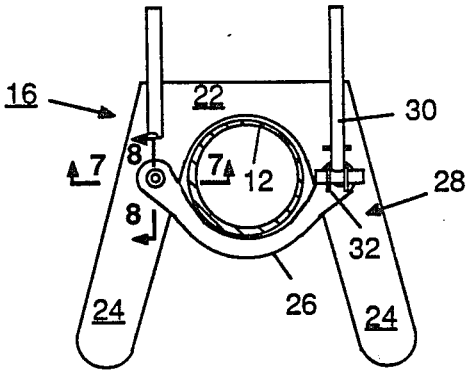
FIG. 3 is a planar view, partially broken away, of the applicant's pile guide.
Figure 4:
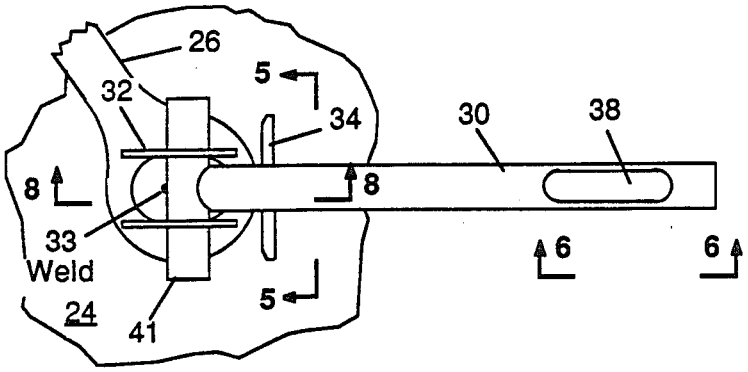
FIG. 4 is a planar view, partially broken away, of a pivoting arm as illustrated in FIG. 3.
Figure 5:
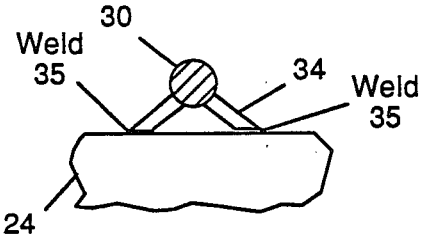
FIG. 5 is a sectional view, partially broken away, taken along lines 5—5 of FIG. 4 of a method of attaching the pivoting arm to the pile guide.
Figure 6:
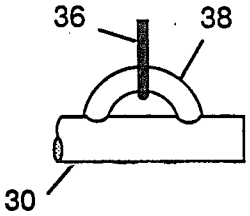
FIG. 6 is a sectional view, partially broken away, taken along lines 6—6 of FIG. 4.
Figure 7:
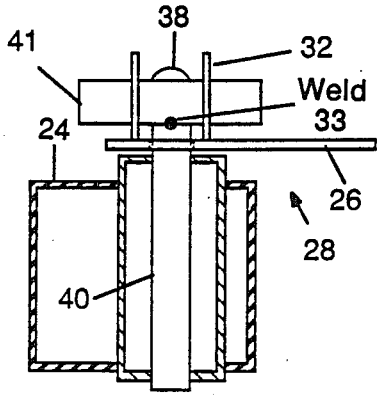
FIG. 7 is a sectional view, partially broken away, taken along lines 7—7 of FIG. 3.
Figure 8:
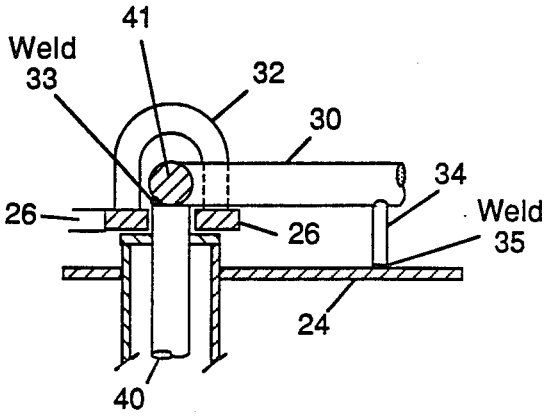
FIG. 8 is a sectional view, partially broken away, taken along lines 8—8 of FIG. 4.

FIG. 3 illustrates an embodiment of the invention. In this case, pile guide 16 surrounds a pile such as skirt pile 12. Pile guide 16 includes fixed support 22 that incorporates a pair of outwardly extending braces 24. Fixed support 22 is configured to nestle or support skirt pile 12 between braces 24. Ring gate 26 spans between braces 24 and restrains skirt pile 12 against fixed support 22. This ring gate 26 is removable from fixed suport 22 and is held in place by connection assembly 28. Each connection assembly 28, which, as shown, connects one end of ring gate 26 to its respective brace 24, includes pivoting arm 30 held by hinge 32.

FIGS. 4, 5, 6, 7, and 8 illustrate, in greater detail, connection assembly 28 and pivoting arm 30. As shown, hinge 32 is secured to ring gate 26 such that when arm 30 is pivoted to an upright position, arm 30, hinge 32, and ring gate 26 each become released from brace 24. Weld bead 33 connects pin 40 to hinge pin 41 while legs 34, welded as shown to brace 24 via weld 35, retain arm 30 in its stored horizontal position, thereby also securing ring gate 26 to brace 24 and around pile 12. To break welds 33 and 35 and to release ring gate 26, cable 36, which is connected to eyelet 38, is pulled thereby pivoting arm 30 in hinge 32 to a more vertical position.

Once arm 30 is no longer secured to brace 24, arm 30 is lifted upward via cable 36 bringing with it ring gate 26 and hinge 32. Ring gate 26 is lifted up over pin 40 in brace 24 before being released. Pin 40, when ring gate 26 is secured around it, acts as a shear pin to both absorb any horizontal force transmitted through ring gate 26 and to restrain pile 12 in place.

During operation, a pile, such as skirt pile 12, is loaded into fixed support 22 between braces 24. Each end of ring gate 26 is then slipped over its respective pin 40 so as to restrain pile 12 in place. Pivoting arm 30, which secures ring gate 26, is then positioned so that attached legs 34 can be welded to brace 24 and hinge pin 41 can be welded to pin 40. Such welding secures ring gate 26 in place. Pile guide 16 is now a closed pile guide restraining preloading pile 12 against structure 10 prior to launching.

Whenever pile 12 is to be released or whenever pile guide 16 is to be converted into an open pile guide, cable 36 is pulled thereby pivoting arm 30 to a more upright position while breaking weld 35 securing legs 34 to brace 24 and breaking weld 33 securing pin 40 to hinge pin 41. Once these welds are broken, cable 36 lifts the connected ring gate 26 from around pin 40 thereby releasing pile 12 from fixed support 22. Pile guide 16 thus has been converted from a closed-type guide to an open-type guide enabling additional piles to be easily positioned within the guide and enabling an underwater hammer to pass through the guide during the hammering operation.

Cable 36 generally extends along the length of the pile that is being restrained with much slack in the line. Oftentimes, in the case of multiple pile guides supporting a single pile, the same cable will be secured to the many pivoting arms. This is accomplished by installing slack in the line between the various pivoting arms. Thus, as the slack is taken out by, say, a winch, only one ring gate is released at a time. Additionally, just above each pile guide, the cable branches to two lines so that at each pile guide, both pivoting arms are activated at the same time.

What is claimed is:

1. A removable closure device for restraining a pile to an offshore structure comprising:

a fixed support surrounding a portion of a pile;

a removable ring gate secured to said support and restraining said pile against said support and between spaced extending braces;

connecting means for removably securing said ring gate to said support, said connecting means comprising a pivotable arm configured to release said ring gate from said support thereby releasing restraint on said pile; and, operating means for operating said pivotable arm.

2. A removable closure device as set forth in claim 1 wherein said ring gate spans between said braces.

3. A removable closure device as set forth in claim 2 wherein said pivotable arm is removably secured to a said brace.

4. A removable closure device as set forth in claim 3 wherein said connecting means comprise a pin securing said ring gate to said brace and wherein said pivotable arm retains said ring gate around said pin.

5. A removable closure device as set forth in claim 4 wherein there are a pair of connecting means secured to opposite ends of said ring gate.

6. A removable closure device as set forth in claim 5 wherein said operating means comprise a cable secured to each of said pivotable arms.

* * * * *